US009700095B2

(12) United States Patent
Futterer

(10) Patent No.: US 9,700,095 B2
(45) Date of Patent: Jul. 11, 2017

(54) MOLDED GEL HEADGEAR HAVING IMPACT DISPERSING PROPERTIES

(71) Applicant: PSE Technology LLC, Raleigh, NC (US)

(72) Inventor: William F. Futterer, Clayton, NC (US)

(73) Assignee: PSE Technology LLC, Raleigh, NC (US)

( * ) Notice: Subject to any disclaimer, the term of this patent is extended or adjusted under 35 U.S.C. 154(b) by 910 days.

(21) Appl. No.: 13/787,672

(22) Filed: Mar. 6, 2013

(65) Prior Publication Data

US 2013/0283505 A1 Oct. 31, 2013

Related U.S. Application Data

(60) Provisional application No. 61/638,325, filed on Apr. 25, 2012, provisional application No. 61/638,333, filed on Apr. 25, 2012.

(51) Int. Cl.
*A42B 3/12* (2006.01)
*A42C 2/00* (2006.01)

(52) U.S. Cl.
CPC ..... *A42B 3/121* (2013.01); *A42C 2/007* (2013.01)

(58) Field of Classification Search
CPC .. A42B 3/121; A42B 3/00; A42B 3/06; A42B 3/32; A42C 2/007; A42C 2/00
See application file for complete search history.

(56) References Cited

U.S. PATENT DOCUMENTS

| | | | | |
|---|---|---|---|---|
| D58,302 | S | 7/1921 | Bartholomew | |
| D58,303 | S | 7/1921 | Bartholomew | |
| 1,697,507 | A | 7/1927 | Karger | |
| D176,046 | S | 11/1955 | Spreiregen | |
| D187,519 | S | 3/1960 | Lasting | |
| 3,444,288 | A * | 5/1969 | Mead | A42B 3/06 156/242 |
| D299,180 | S | 1/1989 | Gentes | |
| 4,912,778 | A | 4/1990 | Daniels | |
| 5,298,208 | A * | 3/1994 | Sibley | A42B 3/125 264/318 |
| 5,437,064 | A | 8/1995 | Hamaguchi | |
| 5,896,587 | A | 4/1999 | Gentry | |
| 5,940,889 | A | 8/1999 | Shirai | |
| 5,946,734 | A | 9/1999 | Vogan | |
| 6,058,515 | A | 5/2000 | Kitahara | |
| 6,122,773 | A | 9/2000 | Katz | |
| 6,237,162 | B1 | 5/2001 | Gill | |
| D473,365 | S | 4/2003 | Bias | |

(Continued)

OTHER PUBLICATIONS

Notice of Allowance dated Oct. 28, 2013 for U.S. Appl. No. 29/447,797, filed Mar. 6, 2013.

(Continued)

*Primary Examiner* — Stella Yi
(74) *Attorney, Agent, or Firm* — NK Patent Law, PLLC

(57) ABSTRACT

A protective molded gel headgear for protecting a wearer during an impact to the wearer's head is provided. The molded gel headgear has a shape that approximates the outer periphery of portions of the wearer's head to be protected. The molded gel headgear is made of an energy absorbing gel material to reduce the impact to the wearer's head during a head-impact event. One or more methods for producing the headgear are also provided.

11 Claims, 6 Drawing Sheets

(56) References Cited

U.S. PATENT DOCUMENTS

| | | | | |
|---|---|---|---|---|
| 6,588,511 | B1 | 7/2003 | Kriesel et al. | |
| D479,020 | S | 8/2003 | Heinrich | |
| 6,896,065 | B2 | 5/2005 | Kriesel et al. | |
| 7,028,344 | B2 | 4/2006 | Toth | |
| 7,041,719 | B2 | 5/2006 | Kriesel et al. | |
| 7,062,795 | B2 | 6/2006 | Skiba et al. | |
| 7,082,623 | B2 | 8/2006 | Johnson et al. | |
| D564,183 | S | 3/2008 | Roach et al. | |
| D565,281 | S | 4/2008 | Dhillon | |
| D565,799 | S | 4/2008 | Timms | |
| D584,000 | S | 12/2008 | Saluan | |
| 7,650,648 | B2 | 1/2010 | Roberts | |
| 8,117,677 | B2 | 2/2012 | Toth | |
| 8,225,419 | B2 | 7/2012 | Hersick et al. | |
| 8,302,213 | B2 | 11/2012 | Kriesel | |
| D686,780 | S | 7/2013 | Rodgers | |
| 2004/0034903 | A1 | 2/2004 | Blair | |
| 2004/0040066 | A1 | 3/2004 | Hardenbrook | |
| 2004/0163162 | A1 | 8/2004 | Benziger | |
| 2006/0005291 | A1 | 1/2006 | Bedford | |
| 2006/0075544 | A1 | 4/2006 | Kriesel et al. | |
| 2008/0026658 | A1 | 1/2008 | Kriesel | |
| 2008/0028499 | A1* | 2/2008 | Skottheim ..... | A42B 3/06 2/414 |
| 2009/0222975 | A1 | 9/2009 | Green et al. | |
| 2011/0113533 | A1 | 5/2011 | Guillen | |
| 2011/0179557 | A1 | 7/2011 | Rabie | |
| 2013/0007948 | A1 | 1/2013 | Chen et al. | |

OTHER PUBLICATIONS

Product weblink: www.unequal.com /dome—for DOME skull cap, Unequal Technologies, 2012; last accessed Mar. 28, 2013.

* cited by examiner

MOLDED GEL HEADGEAR HAVING IMPACT DISPERSING PROPERTIES

CROSS-REFERENCE TO RELATED APPLICATIONS

This application claims priority to U.S. Provisional Application No. 61/638,325 filed on Apr. 25, 2012, and U.S. Provisional Application No. 61/638,333 filed on Apr. 25, 2012, the contents of both of which are hereby incorporated by reference in their entirety.

TECHNICAL FIELD

This disclosure is related to a protective headgear having improved impact dispersing properties, and, more particularly toward an improved headgear configured to be worn in combination with a helmet or other impact resistant headgear or on a stand-alone basis.

BACKGROUND

Helmets are used for lessening the impact a person endures during a collision or similar impact event. Helmets are worn by athletes and recreationalists in activities in which an impact to the wearer's head could occur and cause injury to the wearer, such as, for example, during athletic events such as football, hockey, and the like, and during recreational events, such as riding a bicycle or motorcycle. Helmets are also worn by combat personnel, such as, for example, military personnel, and law enforcement personnel.

Helmets can absorb or disperse significant levels of impact, yet due to limitations of their composition are often unable to absorb sufficient impact energy to prohibit injury to the wearer during an impact event.

Accordingly, new methods, systems, and devices for reducing the energy impact and subsequent degree of injury to a person during an impact event are needed.

SUMMARY

This Summary is provided to introduce a selection of concepts in a simplified form that are further described below in the Detailed Description of Illustrative Embodiments. This Summary is not intended to identify key features or essential features of the claimed subject matter, nor is it intended to be used to limit the scope of the claimed subject matter.

Disclosed herein is a protective molded gel headgear to protect a wearer during a head impact event. The molded gel headgear is shaped to approximate the outer periphery of portions of a wearer's head to provide protection. The molded gel headgear is made of an energy absorbing gel material having characteristics enabling dispersion of a portion of the energy impacting the wearer during an impact event.

According to one or more embodiments, the energy absorbing gel material comprises a plasticizer.

According to one or more embodiments, the energy absorbing gel material comprises a vegetable based plasticizer.

According to one or more embodiments, the energy absorbing gel material comprises a plasticizer, a thermoplastic elastomer, and a prepolymer.

According to one or more embodiments, the energy absorbing gel material comprises an epoxidized vegetable oil, a hydroxyl functional thermoplastic elastomer, and a prepolymer containing an isocyanate or isocyanate monomer.

According to one or more embodiments, the molded gel headgear is constructed by means of an extruding process using a mold.

According to one or more embodiments, the mold for constructing the molded gel headgear (10) defines one or more pins for forming apertures in the molded gel headgear.

According to one or more embodiments, the molded gel headgear comprises one or more spaced-apart apertures for providing ventilation to assist in cooling and heat transfer.

According to one or more embodiments, the mold for constructing the molded gel headgear defines one or more textured areas for providing a textured surface to the molded gel headgear.

According to one or more embodiments, the molded gel headgear comprises a textured surface.

According to one or more embodiments, the molded gel headgear comprises a textured surface on the outside surface thereof.

According to one or more embodiments, the mold for constructing the molded gel headgear defines a cavity that approximates the outer periphery of the portions of the head to be protected.

According to one or more embodiments, the molded gel headgear includes an elastic band around a base thereof for providing elastic engagement to the wearer's head.

According to one or more embodiments, the band is provided on the interior or exterior of the base of the molded gel headgear.

According to one or more embodiments, the band is provided on the interior of the base of the molded gel headgear.

According to one or more embodiments, the band is adhesively adhered or stitched to the molded gel headgear.

According to one or more embodiments, the molded gel headgear is positioned within a sleeve of tubular elastic fabric or material such as, for example, spandex, that encloses the molded gel headgear and forms an apparel article that also approximates the outer periphery of the portions of the wearer's head intended to be protected by the molded gel headgear.

According to one or more embodiments, a method is provided. The method includes providing the protective molded gel headgear and positioning the headgear, either by a person or the wearer, on the wearer's head.

According to one or more embodiments, the method includes providing a helmet to be worn on top of the molded gel headgear worn by the wearer.

BRIEF DESCRIPTION OF THE DRAWINGS

The foregoing summary, as well as the following detailed description of preferred embodiments, is better understood when read in conjunction with the appended drawings. For the purposes of illustration, there is shown in the drawings exemplary embodiments; however, the presently disclosed invention is not limited to the specific methods and instrumentalities disclosed. In the drawings.

DETAILED DESCRIPTION

The presently disclosed invention is described with specificity to meet statutory requirements. However, the description itself is not intended to limit the scope of this patent. Rather, the inventors have contemplated that the claimed invention might also be embodied in other ways, to include different steps or elements similar to the ones described in this document, in conjunction with other present or future technologies.

Figure 1:
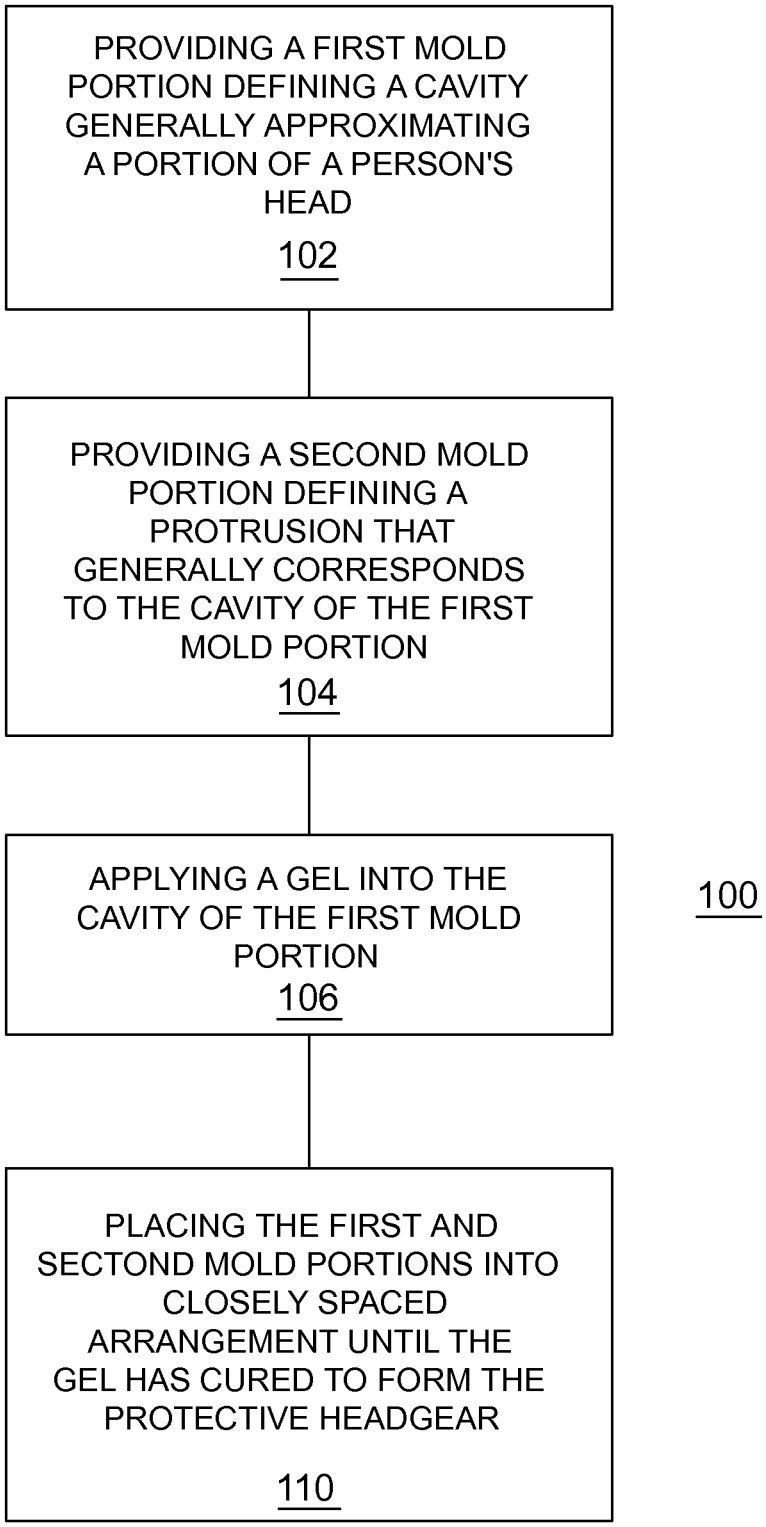
FIG. 1 illustrates a flowchart detailing one or more methods for forming a molded headgear.

FIG. 1 illustrates a flowchart depicting one or more methods for forming a protective headgear according to one or more embodiments disclosed herein. The one or more methods are generally designated 100. The one or more methods 100 may include providing a first mold portion defining a cavity generally approximating a portion of a person's head 102. The mold may be an aluminum or other metal mold and may define or more textural features for providing corresponding textural features to a finished product as will be described in further detail with reference to additional figures disclosed herein. For example, the mold may further define one or more puncture protrusions for making corresponding punctures on the finished product.

The one or more methods 100 may also include providing a second mold portion that defines a protrusion that generally corresponds to the cavity of the first mold portion 104. The second mold portion may be configured such that when the first and second mold portions are in closely-spaced, curing arrangement, a predefined gap or spacing is maintained between the mold portions. The second mold portion may be an aluminum or other metal mold and may also define one or more textural features for providing corresponding textural features to a finished product.

The one or more methods 100 may also include applying a gel into the cavity of the first mold portion 106. The gel may be any gel configured for absorbing impact, and may include, for example, vegetable oil based gels that will be described further herein. A predetermined amount of gel may be provided for a given mold size or desired thickness, density, and the like of a particular headgear. For example, a mold made for a larger headgear would likely require additional amounts of gel for forming the headgear.

The one or more methods 100 may include placing the first and second mold portions into closely-spaced arrangement until the gel has cured to form the protective headgear 108. The time required for curing may depend on a variety of factors, including the type of gel material employed, the amount of gel material, heating or cooling factors applied to the mold, and the like. Once cured, the headgear may be ejected from the first and second mold portions by any appropriate method.

As will be described in further detail herein, the one or more methods 100 may further include providing a film between the cavity of the first mold portion and the gel. The film may be vacuformed. The film may be any appropriately configured film and may be provided for creating a low friction surface on the headgear that also has improved structural characteristics such as resistance to tearing.

The one or more methods 100 may include providing a fabric between the second mold portion and the gel. This fabric may be any appropriately configured fabric, such as woven and non-woven and may be adhered to the gel portion in any appropriately configured way. The one or more methods may include laminating the first mold portion facing surface of the fabric with a laminate layer. The laminate may be provided for aiding in adhering the bottom facing surface of the fabric with the gel material.

The one or more methods 100 may include attaching an elastic band around the periphery of the head gear. The elastic band may be for providing a conforming fit of the headgear to the wearer's head, and may be further provided for additionally securing each of the film, laminate layer, gel, and fabric to one another to form the headgear.

Figure 2:
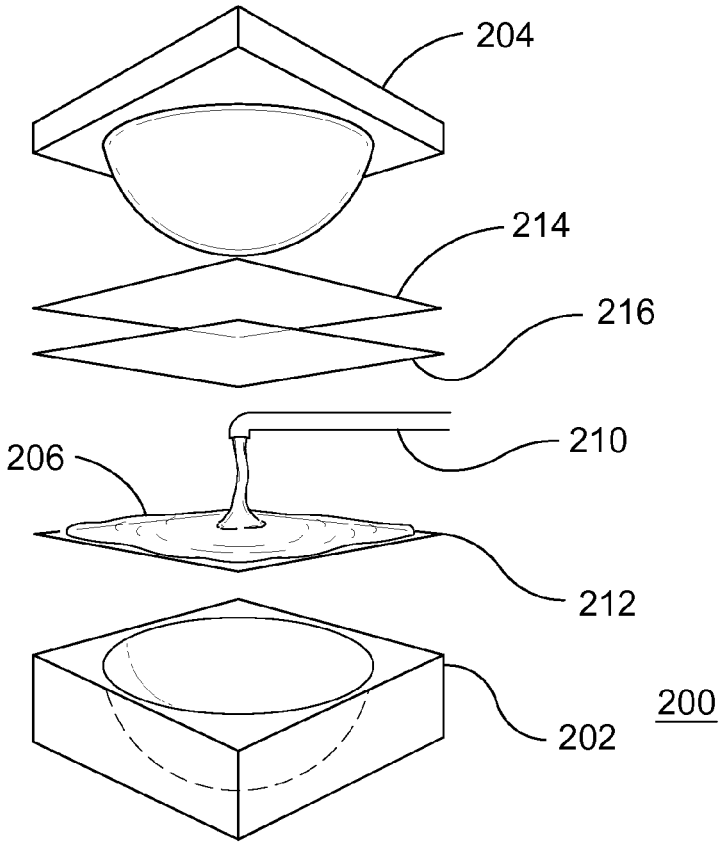
FIG. 2 illustrates an exploded view of a mold assembly and materials for forming a headgear according to one or more embodiments disclosed herein.
Figure 3:
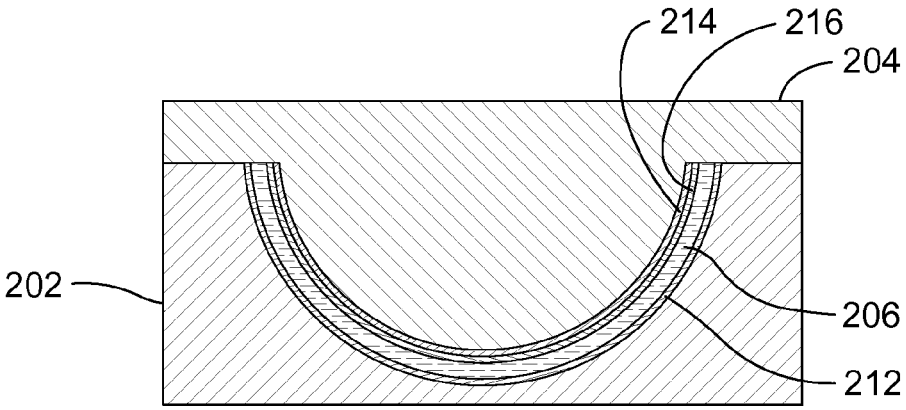
FIG. 3 illustrates a collapsed view of a mold assembly and materials for forming a headgear according to one or more embodiments disclosed herein.

The mold assembly is illustrated in FIG. 2 and FIG. 3 and is generally designated 200. The mold assembly 200 generally includes a first mold portion 202 that defines a cavity or recess therein that approximates the shape of a wearer's head. A second mold portion 204 defines a protrusion that approximates the cavity of the first mold portion 202 and thus the shape of the wearer's head. A gel material 206 may be injected into the recess of the first mold portion 202 by an injector 210. The injector 210 is optionally shown as a stand-alone structure, or may be incorporated through an injection gate or similar defined in one of the mold portions 202 and 204. A film layer 212 may be provided beneath the gel 206 and the first mold portion 202. A fabric 214 may be provided between the second mold portion 204 and the gel material 206, and, further, a laminate 216 may be provided between the fabric material 214 and the gel 206. Heat may be applied to help cure the gel material, and, upon curing, the headgear material may be trimmed to shape and configured for further processing. The fabric and/or gel material or any other structure forming the headgear may define one or more antimicrobial and wicking properties.

Figure 4:
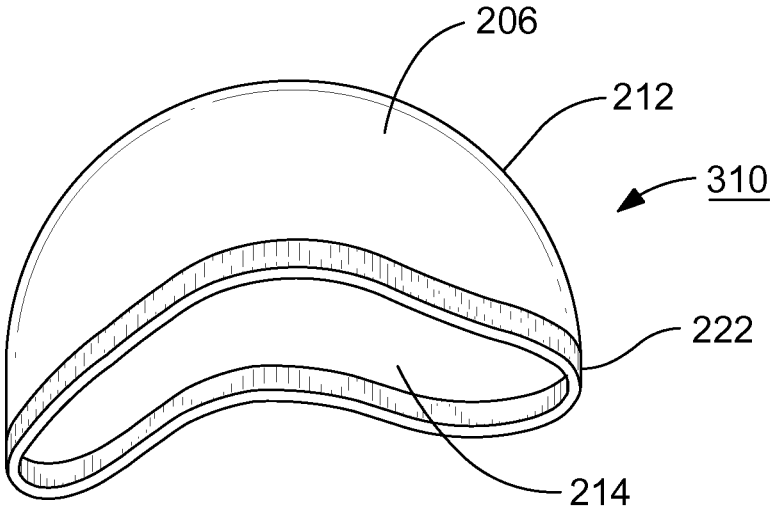
FIG. 4 illustrates a molded gel headgear having an elastic band about a base thereof according to one or more embodiments disclosed herein.

FIG. 4 illustrates a molded gel headgear 310 made according to the one or more methods described in reference to FIGS. 1 through 3. FIG. 4 illustrates the molded gel headgear 310 having an elastic band 222 about the base of the headgear 310. This is advantageous for closely engaging the molded gel headgear 310 to the wearer's head. In some embodiments, the band 222 is adhesively applied to the molded gel headgear 310 or sewn by stitching to the molded gel headgear 310. The adhesive used to adhere the band 222 to the headgear 310 can be, for example, a pressure sensitive adhesive or a structural adhesive.

Figure 5:
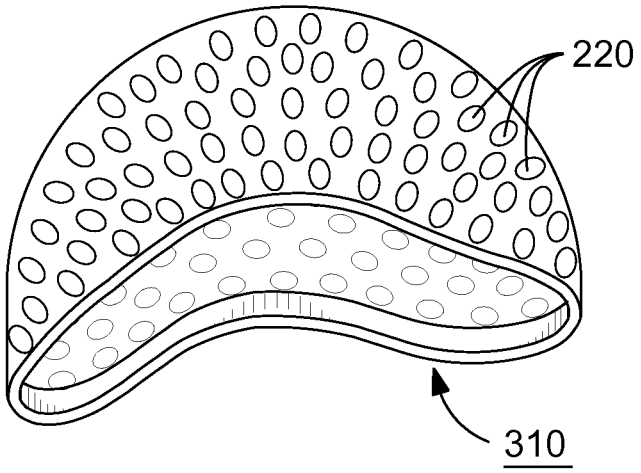
FIG. 5 illustrates a molded gel headgear having apertures defined therethrough according to one or more embodiments disclosed herein.
Figure 6:
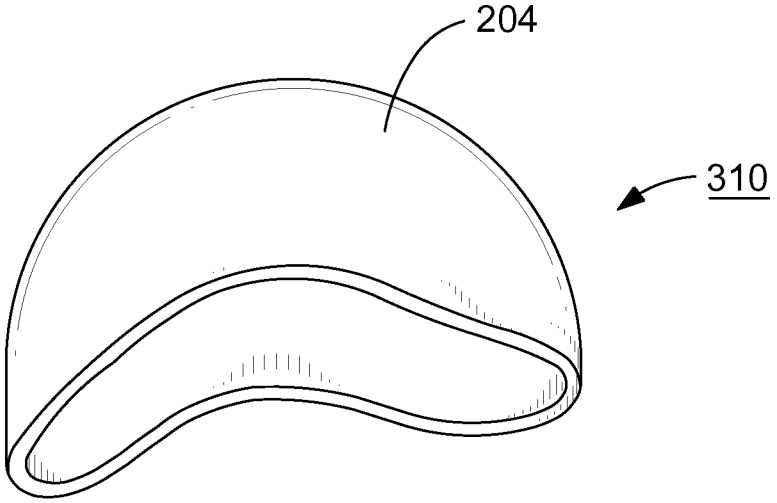
FIG. 6 illustrates a molded gel headgear having texturizing on an outside thereof according to one or more embodiments disclosed herein.
Figure 7:
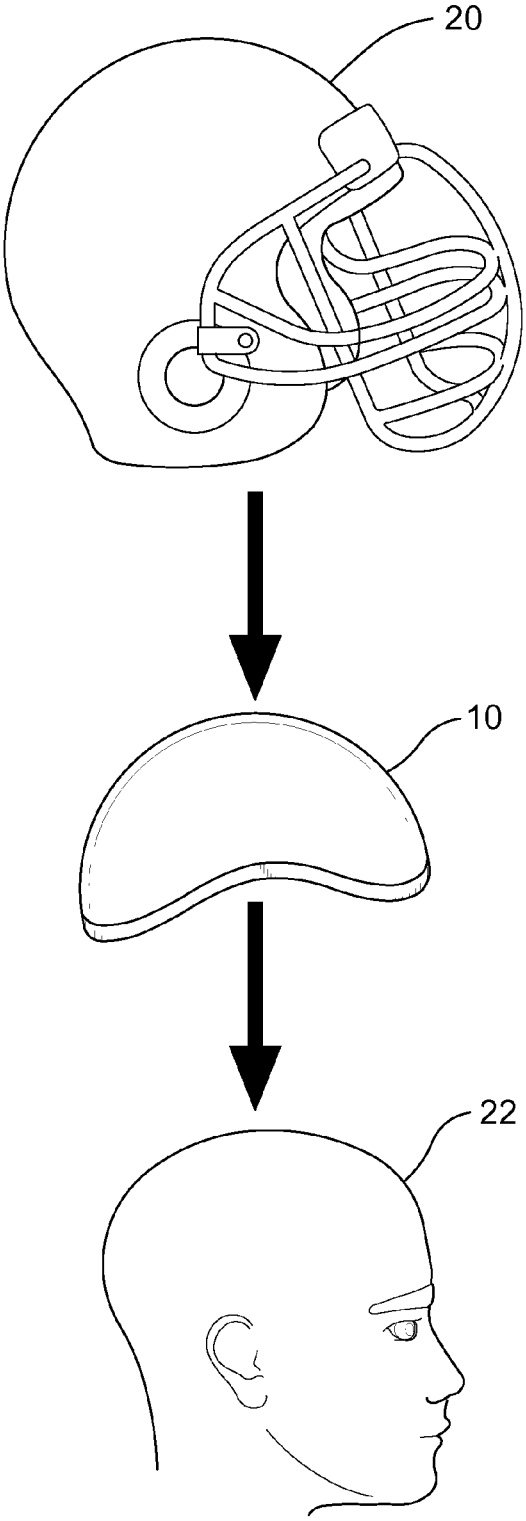
FIG. 7 illustrates a helmet to be worn on top of the molded gel headgear worn by a wearer according to one or more embodiments disclosed herein.

FIG. 5 illustrates the molded gel headgear 310 having apertures 220 defined through the headgear. FIG. 6 illustrates the molded gel headgear 210 having texturizing 224 on the outside surface of the headgear. Alternatively, the molded gel headgear 210 may include a textured surface 224 on an inside surface of the headgear in embodiments in which the sheet of fabric 214 is not provided.

The molded gel headgear 210 may include a gel material possessing energy absorbing properties (or otherwise herein referred to as impact dispersing properties) that is formed into a mold that approximates the shape of needed area for head protection such as the forehead, temples, crown and rear/base of the skull. According to one or more embodiments, the energy absorbing molded gel is coated with a substance to reduce the tackiness/stickiness of the gel material 212. In some embodiments, the coating substance is a polyurethane film or a spray.

FIG. 6 illustrates that the molded gel headgear 310 is designed to be worn by a wearer on their head 22 underneath a helmet 20, or, alternatively, as a stand-alone product. The molded gel headgear reduces residual gravitational force ("G Force") impacts, not otherwise dispersed by a helmet, which in the absence of the molded gel headgear would reach the wearer's skull without the impact dispersement provided by the molded gel headgear. By dispersing a portion of the G Force energy that would otherwise impact the wearer's skull, the molded gel headgear diminishes the direct G Force energy caused by the impact and rotational effects caused by the impact (that is, the movement of the brain within the skull following an impact, causing the brain to strike against the skull one or more times, and potentially causing injury to the brain). The percentage of diminishment of energy reaching the skull through the molded gel headgear varies according to multiple factors, including but not limited to the location of the impact, the direction of the impact, the quality of the helmet worn on top of the headgear if a helmet is used, the position of the wearer's head and neck, and the force of the impact. The helmet 20 to be worn over the molded gel headgear 310 can be any helmet for which additional protection is desired to prevent impact to the wearer's head, including but not limited to, for example, helmets for sports or recreational activities, helmets for combat activities, football helmets, bicycle helmets, hockey helmets, motorcycle helmets, military helmets, and law enforcement helmets. According to one or more embodiments, the size of the molded gel headgear is produced to fit the size of the particular helmet desired. For example, the molded gel headgear to be worn under a bicycle helmet could be smaller and cover less of the wearer's skull area than say, for example, a molded gel headgear 310 to be worn under a football helmet.

According to one or more embodiments, the molded gel headgear 310 may be produced by the one or more methods disclosed in FIGS. 1 through 3. Aluminum cast molds are made in the size and shape of the desired molds of the skull area previously described for the energy absorbing gel material. According to one or more embodiments, the aluminum mold may define one or more pins for forming apertures 220 on the molded gel headgear 310. The one or more apertures 222 are provided for improving heat mitigation characteristics. According to one or more embodiments, the one or more apertures 222 are made during the molding process by use of a plurality of corresponding pins, spikes, or punches or the like that form the apertures, or are made after the molding process with an appropriately configured cutting or stamping tool. The apertures can be of any appropriately configured shape, size, and spacing. In one or more embodiments, the fabric-formed apparel article 214 has matching or additional apertures provided. Additionally, according to one or more embodiments, the mold may define one or more protrusions or extrusions for forming a textured surface 224 on the molded gel headgear.

A liquid form of the precursor energy absorbing gel material 206 is poured into the aluminum molds, and then allowed to harden/cure to form the molded gel headgear 310. According to one or more embodiments, the energy absorbing molded gel may be coated with a substance to reduce the tackiness/stickiness of the gel material to form the molded gel headgear 10. In some embodiments, the coating substance is a polyurethane film or a spray. In one or more embodiments, the material may be thin film 212.

The molded gel headgear 310 is made from the energy absorbing gel material 206. According to one or more embodiments, the energy absorbing gel material includes a plasticizer. According to one or more embodiments, the energy absorbing gel material includes a vegetable based plasticizer. According to one or more embodiments, the energy absorbing gel material includes a plasticizer, a thermoplastic elastomer, and a prepolymer. According to one or more embodiments, the energy absorbing gel material includes an epoxidized vegetable oil, a hydroxyl functional thermoplastic elastomer, and a prepolymer containing an isocyanate or isocyanate monomer.

While the embodiments have been described in connection with the preferred embodiments of the various figures, it is to be understood that other similar embodiments may be used or modifications and additions may be made to the described embodiment for performing the same function without deviating therefrom. Therefore, the disclosed embodiments should not be limited to any single embodiment, but rather should be construed in breadth and scope in accordance with the appended claims.

What is claimed:

1. A method for forming a protective headgear, comprising:

providing a first mold portion defining a cavity generally approximating a portion of a person's head;

providing a second mold portion defining a protrusion that generally corresponds to the cavity of the first mold portion;

providing a fabric sheet beneath the second mold portion;

laminating a face of the fabric sheet that faces the first mold portion;

providing a film on the cavity of the first mold portion;

applying a gel onto the film into the cavity of the first mold portion;

placing the first and second mold portions into closely-spaced arrangement until the laminated face of the fabric sheet contacts the gel and the gel has cured to form the protective headgear, wherein the gel does not contact the first mold portion after the gel is applied; and stitching a band around a periphery of the headgear;

wherein one of the first and second mold portions further defines one or more punches for forming ventilation apertures in the headgear, wherein the ventilation apertures extend through each of the fabric sheet, laminated face, and gel, wherein, in use, the headgear is positioned on a wearer's head beneath a helmet.

2. The method according to claim 1, wherein the film is vacuformed.

3. The method according to claim 1, wherein the laminated surface of the fabric is vacuformed.

4. The method according to claim 1, further including providing heat to the first and second mold portions.

5. A method for reducing impact on a wearer's head, the method comprising:

providing a molded gel headgear between a helmet and the wearer's head, wherein the molded gel headgear comprises:

a gel material molded into a shape that approximates the shape of a wearer's head; and a sheet of fabric attached to a side of the gel material that faces the wearer's head and is in continuous engagement therewith when the wearer is wearing the headgear, wherein the sheet of fabric is laminated on a side facing away from the wearer's head;

a band stitched around a periphery of the headgear, wherein each of the gel material, the laminate, and the sheet of fabric define one or more ventilation apertures, wherein the headgear is made by applying the gel onto a film positioned in the cavity of a first mold portion, and placing the first and second mold portions into closely-spaced arrangement until the laminated face of the fabric sheet contacts the gel and the gel has cured to form the protective headgear, wherein the gel does not contact the first mold portion after the gel is applied.

6. The method according to claim 5, wherein the gel material comprises one of a plasticizer, a vegetable based plasticizer, a thermoplastic elastomer, a prepolymer, an epoxidized vegetable oil, a hydroxyl functional thermoplastic elastomer, and a prepolymer containing an isocyanate or isocyanate monomer.

7. The method according to claim 5, wherein the headgear further includes a thin film on a surface of the gel material that faces the helmet when the helmet is installed on the wearer's head.

8. The method according to claim 5, wherein the headgear further includes an elastic band disposed around and extending through a periphery of the gel material and the sheet of fabric.

9. The method according to claim 1, wherein the gel comprises one of a plasticizer, a vegetable based plasticizer, a thermoplastic elastomer, a prepolymer, an epoxidized vegetable oil, a hydroxyl functional thermoplastic elastomer, and a prepolymer containing an isocyanate or isocyanate monomer.

10. The method according to claim 5, further including providing heat to the first and second mold portions.

11. A method for forming a protective headgear, comprising;

providing a first mold portion defining a cavity generally approximating a portion of a person's head;

providing a second mold portion defining a protrusion that generally corresponds to the cavity of the first mold portion;

providing a fabric sheet beneath the second mold portion;

laminating a face of the fabric sheet that faces the first mold portion;

providing a film on the cavity of the first mold portion;

applying a gel onto the film into the cavity of the first mold portion;

placing the first and second mold portions into closely-spaced arrangement until the laminated face of the fabric sheet contacts the gel and the gel has cured to form the protective headgear, wherein the gel does not contact the first mold portion after the gel is applied; and providing heat to the first and second mold portions;

stitching a band around a periphery of the headgear;

wherein one of the first and second mold portions further defines one or more punches for forming ventilation apertures in the headgear, wherein the ventilation apertures extend through each of the fabric sheet, laminated face, and gel, wherein, in use, the headgear is positioned on a wearer's head beneath a helmet, wherein the gel material comprises one of a plasticizer, a vegetable based plasticizer, a thermoplastic elastomer, a prepolymer, an epoxidized vegetable oil, a hydroxyl functional thermoplastic elastomer and a prepolymer containing an isocyanate or isocyanate monomer.

* * * * *